US011737935B2

(12) United States Patent
Smart et al.

(10) Patent No.: US 11,737,935 B2
(45) Date of Patent: Aug. 29, 2023

(54) FIELD STRETCHER WITH A DETACHABLE BASE

(71) Applicant: TSG ASSOCIATES LLP, Halifax (GB)

(72) Inventors: Colin Smart, Halifax (GB); Simon Eric Pennells, Halifax (GB)

(73) Assignee: TSG ASSOCIATES LLP, Halifax (GB)

( * ) Notice: Subject to any disclaimer, the term of this patent is extended or adjusted under 35 U.S.C. 154(b) by 642 days.

(21) Appl. No.: 16/074,071

(22) PCT Filed: Jan. 6, 2017

(86) PCT No.: PCT/GB2017/050023

§ 371 (c)(1),
(2) Date: Jul. 30, 2018

(87) PCT Pub. No.: WO2017/129942

PCT Pub. Date: Aug. 3, 2017

(65) Prior Publication Data

US 2020/0000654 A1 Jan. 2, 2020

(30) Foreign Application Priority Data

Jan. 28, 2016 (GB) ..... 1601615

(51) Int. Cl.
*A61G 1/044* (2006.01)
*A61G 1/048* (2006.01)
(Continued)

(52) U.S. Cl.
CPC ..... *A61G 1/044* (2013.01); *A61G 1/048* (2013.01); *A61G 1/003* (2013.01); *A61G 1/007* (2013.01);
(Continued)

(58) Field of Classification Search
CPC ..... A61G 1/044; A61G 1/048; A61G 1/01; A61G 1/04; A61G 1/003; A61G 1/007; A61G 1/013; A61G 7/1023
See application file for complete search history.

(56) References Cited

U.S. PATENT DOCUMENTS 919,159 A * 4/1909 Goddard ..... A61G 1/01 5/628
2,899,692 A * 8/1959 Finken ..... A61G 1/01 5/628

(Continued)

FOREIGN PATENT DOCUMENTS

EP 2303210 A1 4/2011
WO WO2009156748 A1 12/2009

*Primary Examiner* — David R Hare
*Assistant Examiner* — Morgan J McClure
(74) *Attorney, Agent, or Firm* — Nixon & Vanderhye P.C.

(57) ABSTRACT

A field stretcher (102) comprising a patient carrying portion (104), a region thereof being operable to form a patient retaining pocket (150) for retaining the patient on the stretcher, in use and wherein the field stretcher further comprises attachment means operable to allow attachment of a detachable base plate. The invention also extends to a detachable base plate (202) comprising attachment means (270) operable to allow attachment of the base place to the field stretcher, a sheltering means and a field stretcher assembly (302) and field stretcher kit of such.

25 Claims, 8 Drawing Sheets

Figure 1:
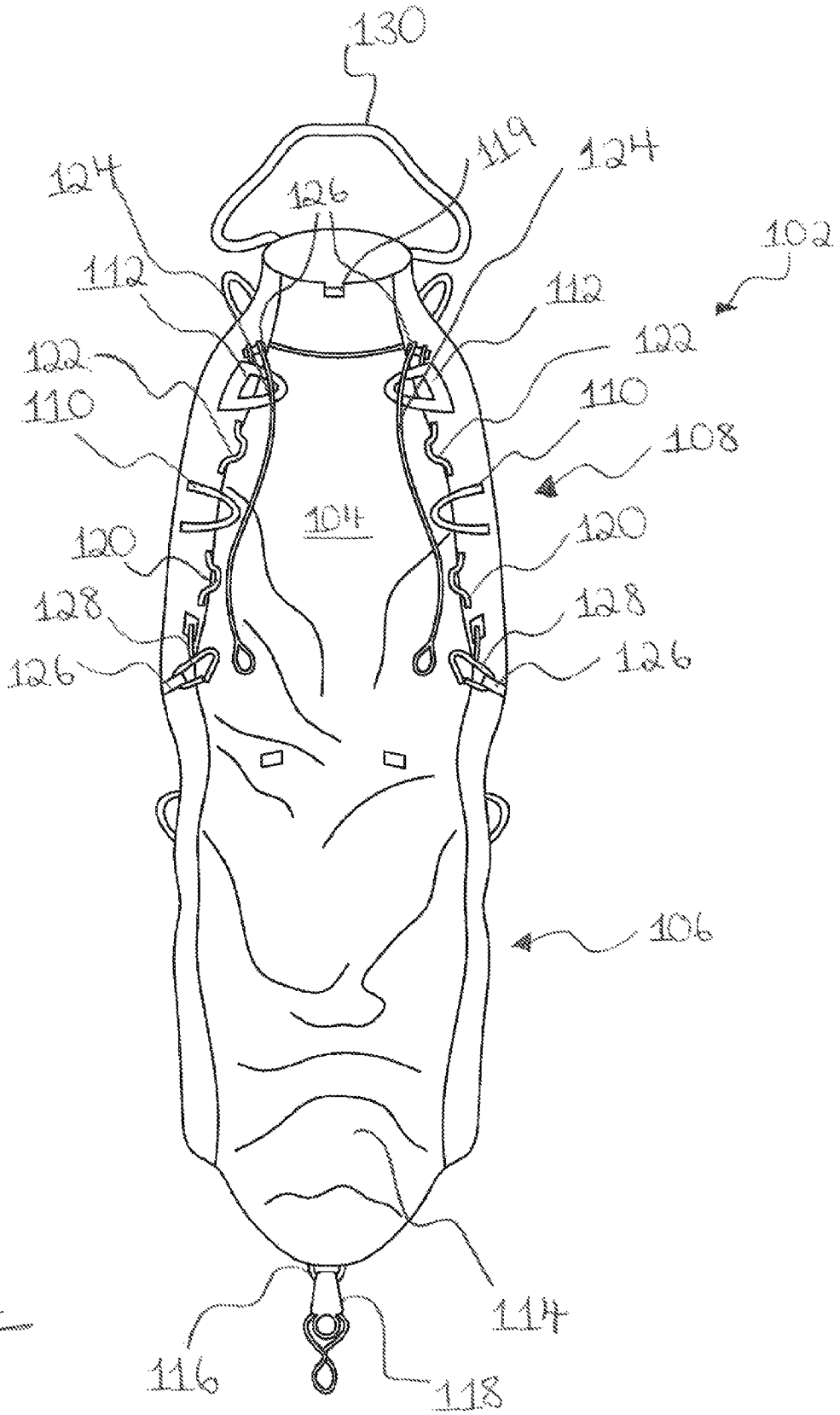

(51) Int. Cl.

| | |
|---|---|
| ***A61G 7/10*** | (2006.01) |
| ***A61G 1/007*** | (2006.01) |
| ***A61G 1/003*** | (2006.01) |
| ***A61G 1/013*** | (2006.01) |
| ***A61G 1/04*** | (2006.01) |

(52) U.S. Cl.
CPC ..... *A61G 1/013* (2013.01); *A61G 1/04* (2013.01); *A61G 7/1023* (2013.01)

(56) References Cited

U.S. PATENT DOCUMENTS 3,601,824 A * 8/1971 Bradford ..... A61G 1/04 5/628
4,655,206 A * 4/1987 Moody ..... A61G 1/01 5/628
5,088,137 A * 2/1992 Rose ..... A61G 1/01 128/870
5,189,746 A * 3/1993 Horie ..... A61G 1/01 5/627
5,819,746 A * 10/1998 Walton ..... A61G 1/00 128/869
6,948,203 B2 * 9/2005 Tsai ..... A45F 4/02 5/626
8,365,326 B2 * 2/2013 Kenalty ..... A61G 1/00 5/628
8,793,827 B1 * 8/2014 Smart ..... A61G 1/048 5/627
2002/0112754 A1 * 8/2002 Gauger ..... A62B 31/00 135/128
2005/0051203 A1 * 3/2005 McCully ..... A47G 9/086 135/87
2007/0136950 A1 * 6/2007 Zuercher ..... A47G 9/086 5/627
2007/0278754 A1 * 12/2007 Walkingshaw ..... B62B 15/00 280/20
2009/0288255 A1 * 11/2009 Sakurai ..... A61G 7/05753 5/625
2010/0299836 A1 * 12/2010 Tanaka ..... A47C 31/08 5/626
2011/0177733 A1 * 7/2011 Grimes ..... A61G 1/02 441/80
2012/0284923 A1 * 11/2012 Jensen ..... A61G 1/04 5/627
2013/0227791 A1 * 9/2013 Kostron ..... A61G 1/01 5/629
2013/0276235 A1 * 10/2013 Kenalty ..... A61G 1/0287 5/627
2014/0053335 A1 * 2/2014 Calkin ..... A61G 1/044 5/628
2014/0366272 A1 12/2014 Smart et al.
2019/0133850 A1 * 5/2019 Offen ..... A61G 1/013

* cited by examiner

FIELD STRETCHER WITH A DETACHABLE BASE

CROSS REFERENCE TO RELATED APPLICATIONS

This application is a § 371 National Phase Application of PCT/GB2017/050023 filed Jan. 6, 2017, which claims priority to GB 1601615.6 filed Jan. 28, 2016.

The present invention relates to field stretchers, particularly for recovering wounded soldiers from field.

Field stretchers are known in the art and are used for transporting wounded individuals in the field. They differ from medical stretchers used in medical facilities in that they are designed to be lightweight and compact, enabling the field stretcher to be carried about an individuals person and a casualty to be moved by a single person.

Known field stretchers comprise a simple piece of fabric material upon which an injured person may be placed, then the stretcher dragged to a position of safety. Problems with this type of stretcher exist in that a wounded individual may roll off the stretcher during transport. It is also desirable to prevent excessive movement of the head and neck of the injured person. Also, in many instances, such stretchers are used to recover soldiers or other casualties from mine fields, having been wounded by a land mine. Often in such cases a patients legs may have been severely injured or removed and as such may have a significantly reduced body length. In such scenarios, known field stretchers are inappropriate since they are too large and again promote the incidence of patients rolling off the stretcher. The inappropriate length also dictates that carry handles are no longer in the optimum place for safe patient carriage.

The simple fabric material of known field stretchers provides no means of insulation from the ground for an injured person placed thereon. Further, in many instances, the material gives only limited support to the spinal region of the wounded individual when moving them (often by dragging). Problems with this type of field stretcher exist in that the swiftness and efficiency at which a patient can be dragged from the field depends on the terrain. Such field stretchers may also facilitate heat transfer to the injured person as a result of friction during the dragging of the stretcher over particular types of terrain.

It is an object of aspects of the present invention to provide a solution to the above mentioned or other problems.

According to a first aspect of the present invention there is provided a field stretcher comprising a patient carrying portion, a region thereof being operable to form a patient retaining pocket for retaining the patient on the stretcher, in use and wherein the field stretcher further comprises attachment means operable to allow attachment of a detachable base plate.

Preferably, the field stretcher comprises one or more handles, preferably to thereby facilitate the stretcher being dragged.

Preferably the patient carrying portion has a lower region and preferably an upper region. Preferably, the lower region generally corresponds to a position of a lower portion of a patient's body, in use. Preferably, the upper region generally corresponds to a position of an upper portion of a patient's body, in use.

Preferably, the patient carrying portion is generally elongate and is preferably generally coffin shaped in plan. Preferably, the patient carrying portion comprises one or more handle at or toward an upper end thereof, preferably being the longitudinal terminus of the upper region.

Preferably, the patient carrying portion comprises one or more handles along sides thereof. Preferably, the handles are arranged in pairs, preferably at opposing sides of the patient carrying portion.

Preferably, the stretcher comprises a retaining region which is preferably operable to form a part of the patient retaining pocket, in use.

The retaining region may be joined to the lower region of the patient carrying portion. The retaining region may comprise an upstanding portion.

The patient carrying portion may comprise one or more shortening means operable to shorten a portion, preferably a portion of the perimeter, of the patient carrying portion. In this manner, a patient retaining pocket may be formed. The shortening means may extend around a portion of the perimeter of the patient carrying portion and may extend around a portion of the perimeter of the retaining region. An example of perimeter shortening means is a drawstring. The field stretcher may comprise one or more drawstring operable to draw the patient carrying portion, thereby forming the patient retaining pocket. The drawstring may extend around a portion of an edge of the patient carrying portion. The drawstring may extend around a portion of the retaining region. In one embodiment, the patient carrying portion may comprise a first drawstring and a second drawstring. Preferably, a first drawstring is operable to draw the lower region of the patient carrying portion to form a patient retaining pocket and a second drawstring is operable to draw the upper region of the patient carrying portion about the shoulder and head area of the patient.

The or each drawstring may be provided with a toggle to preferably allow the drawstring to be retained in a drawn position.

Preferably, the patient carrying portion is formed from a fabric material, preferably an abrasion resistant fabric material. The material may be synthetic. An example of a suitable material is Cordura® commercially available from Invista.

The patient carrying portion may comprise one or more securing means operable to secure a patient within the patient carrying portion, thereby retaining an injured person during transport. The securing means may be situated at or toward upper attachment points, which may be situated at opposing sides of the patient carrying portion, at or towards the upper end thereof, such as in the region of the shoulder and neck area of the patient.

Preferably, the patient carrying portion comprises one or more linking means along the sides thereof. Preferably, the linking means are arranged in pairs, preferably on opposing sides of the patient carrying portion.

Preferably, the securing means are secured at and may extend from upper attachment points, and may be operable, in use, to pass across the chest of the injured person and over to linking means on the opposite side of the patient carrying portion. Preferably, the linking means comprise an aperture therethrough, through which the securing means may be threaded. Suitable linking means include handle, grommets and sewn holes. Preferably, the linking means comprise handles. Preferably, the securing means are operable to overlap across the patients torso. The securing means may comprise an elongated flexible member. Suitable securing means include straps, cords, lines and further, may be extendible. Preferably, the securing means may terminate in a looped region operable to engage with fixing means. Such fixing means are preferably operable to fix the securing means to lower attachment points on opposing sides, at or towards the lower end thereof of the patient carrying portion. Suitable fixing means include karabiners, hooks and clips.

The securing means may be secured at and extend from the upper attachment points on opposing sides, at or towards the upper end of the patient carrying portion and secured at the lower attachment points, and may be operable, in use, to pass across the chest of the injured person and over to linking means on the opposite side of the patient carrying portion. Suitable linking means include loops and eyelets, in particular re-sealable loops. Preferably, the linking means are loops comprising hook and pile fastenings.

The field stretcher comprises attachment means operable to allow attachment of a detachable base plate, preferably to the underside of the field stretcher or at least a portion thereof. Preferably, the attachment means are arranged so as to extend generally around the perimeter of the underside of the field stretcher.

Preferably, the attachment means is formed from a fabric material similar to that from which the patient carrying portion of the field stretcher is formed. Preferably, the attachment means comprises a plurality of loops.

The field stretcher may further comprise one or more transporting means, to thereby facilitate transportation of the field stretcher. The one or more transporting means may be attachable to the patient carrying portion at attachment points. Such attachment points may be the one or more handles along the sides of the patient carrying portion of the field stretcher. The one or more transporting means may preferably be attachable to one or more handles towards the upper region of the patient carrying portion of the field stretcher. The one or more transporting means may be attachable to the field stretcher via fastening means. Suitable fastening means include karabiners, clips and hooks.

The one or more transporting means may be attachable to the field stretcher at a single attachment point or multiple attachment points. The one or more transporting means may comprise a plurality of integrally formed loops. When attached to multiple attachment points, such as two attachment points, the length of the one or more transporting means may be operable to be adjusted using the integrally formed loops to accommodate differing heights of those transporting the field stretcher. The one or more transporting means may be formed from any suitable materials. Suitable materials include but are not limited to materials such as, for example, nylon and/or polyester webbing.

The field stretcher may further have sheltering means operable to be secured there over, the sheltering means may be operable to, in use, protect the injured person from adverse weather conditions. Preferably, the size and shape of the sheltering means is generally elongate and preferably, coffin shaped in plan. Preferably, the size and shape of the sheltering means is arranged to generally correspond to that of the patient carrying portion of the field stretcher. Preferably, the sheltering means has a lower region and preferably, an upper region. Preferably, the lower region generally corresponds to a position of a lower portion of a patient's body, in use. Preferably, the upper region generally corresponds to a position of an upper portion of a patient's body in use.

The upper region of the sheltering means may be hooked over the upper region of the patient carrying portion, corresponding to the region closest the patient's head and chest in use. The sheltering means may comprise one or more shortening means operable to shorten a portion, preferably a portion of the perimeter of the sheltering means, thereby securing the sheltering means to the field stretcher. The shortening means may be positioned on the perimeter of the lower region of the sheltering means and may be operable, in use, to secure the lower region of the sheltering means to the lower region of the patient carrying portion of the field stretcher upon tightening of the shortening means. An example of shortening means is a drawstring. Preferably, the sheltering means comprises an opening in the upper region of the sheltering means, corresponding to the position of the patient's head and chest to enable, in use, access to a patient's head and chest region. Preferably, accessing means extends from the opening. Preferably, the accessing means is arranged along the longitudinal length of the patient's body, in use, and is operable to allow easy access to the injured persons in use. Any suitable accessing means may be used. Suitable accessing means includes but is not limited to a zip, buttons, press studs and hook and pile fastenings or combinations thereof. The sheltering means may be formed from any suitable material. Preferably, the sheltering means is generally water resistant or generally waterproof. Preferably, the material is water resistant, yet breathable. Suitable materials include but are not limited to materials comprising nylon, polyester, polyurethane, silnylon, gore-tex, polyethylene, polypropylene and treated polytetrafluoroethylene or combinations thereof.

According to a second aspect of the present invention, there is provided a detachable base plate comprising attachment means operable to allow attachment of the base plate to the field stretcher according to the first aspect of the present invention.

Preferably, the size and shape of the detachable base plate is generally elongate and preferably, generally coffin shaped in plan. Preferably, the size and shape of the detachable base plate is arranged to generally correspond to that of the patient carrying portion of the field stretcher according to the first aspect of the present invention.

Preferably, the detachable base plate has a lower region and preferably an upper region. Preferably, the lower region generally corresponds to a position of a lower portion of a patient's body, in use. Preferably, the upper region generally corresponds to a position of an upper portion of a patient's body, in use.

Preferably, the upper surface of the detachable base plate or at least a portion thereof comprises a layer of insulating material. Preferably, the insulating material may comprise a foam based material. Suitable materials may be selected from: open-cell foam, closed-cell foam. The insulating material may be up to 10 mm in thickness, preferably between 1-5 mm. In one embodiment, the insulating material may be substantially 3 mm.

Preferably, the detachable base plate comprises dragging means at or toward the longitudinal end of the upper region thereof. Suitably, the dragging means is operable to allow the field stretcher to be dragged. Preferably, the dragging means is positioned in proximity to the edge of the detachable base plate. The dragging means may be of adjustable or fixed length. Preferably, the dragging means may be operable to form a loop. Suitable dragging means includes a strap and/or a handle.

Preferably, the detachable base plate comprises a plurality of attachment means operable to allow attachment of the base plate to attachment means of the field stretcher according to the first aspect of the present invention. Preferably, the attachment means are arranged so as to extend generally around the perimeter of the detachable base plate. Preferably, the attachment means comprise apertures in the material of the detachable base plate. Preferably, the attachment means are located so as to generally correspond with the position of the attachment means on the underside of the fabric field stretcher according to the first aspect of the present invention.

Preferably, the attachment means may be operable to engage with a linking member. Such linking members may be operable to form an attachment between the attachment means of the base plate and the corresponding attachment means on the underside of the field stretcher according to the first aspect of the present invention. Optionally, the attachment means may comprise a linking member as an integral part. Suitable linking members include tags. Suitably, the tags may be tied in any suitable fashion. In one embodiment, the tags may be lockable in a first direction. The tags may be formed from any suitable material, such as, for example, plastic. The tags are preferably of any suitable width, such as 1 to 10 mm, preferably 1 to 5 mm. In one embodiment, the tags may be substantially 3 mm.

Preferably, the detachable base plate is formed from a malleable material, preferably a plastic material. Examples of suitable materials include plastics formed from polymers and/or copolymers, such as polyethylene. Preferably, the detachable base plate may be up to 5 mm in thickness, preferably between 0.5-3.5 mm. In one embodiment, the detachable base plate may be substantially 1 mm in thickness.

According to a third aspect of the present invention, there is provided a sheltering means operable to be secured over a field stretcher, the field stretcher comprising a patient carrying portion, a region thereof being operable to form a patient retaining pocket for retaining the patient of the stretcher, in use and wherein the field stretcher further comprises attachment means operable to allow attachment of a detachable base plate.

According to a fourth aspect of the present invention, there is provided a sheltering means operable to be secured over a field stretcher assembly, the field stretcher assembly comprising: a field stretcher comprising a patient carrying portion, a region thereof being operable to form a patient retaining pocket for retaining the patient on the stretcher, in use, wherein the field stretcher further comprises attachment means and a detachable base plate attached to the field stretcher.

According to a fifth aspect of the present invention, there is provided a field stretcher assembly comprising: a field stretcher comprising a patient carrying portion, a region thereof being operable to form a patient retaining pocket for retaining the patient on the stretcher, in use, wherein the field stretcher further comprises attachment means and a detachable base plate attached to the field stretcher.

According to a sixth aspect of the present invention, there is provided a field stretcher assembly comprising: a field stretcher comprising a patient carrying portion, a region thereof being operable to form a patient retaining pocket for retaining the patient on the stretcher, in use, wherein the field stretcher further comprises attachment means, a detachable base plate attached to the field stretcher and sheltering means secured over the field stretcher and detachable base.

According to a seventh aspect of the present invention, there is provided a field stretcher kit comprising: a field stretcher comprising a patient carrying portion, a region thereof being operable to form a patient retaining pocket for retaining the patient on the stretcher, in use, wherein the field stretcher comprises attachment means operable to allow attachment of a detachable base plate, and a detachable base plate comprising attachment means operable to allow attachment of the detachable base plate to the field stretcher.

According to an eighth aspect of the present invention, there is provided a field stretcher kit comprising: a field stretcher comprising a patient carrying portion, a region thereof being operable to form a patient retaining pocket for retaining the patient on the stretcher, in use, wherein the field stretcher comprises attachment means operable to allow attachment of a detachable base plate, a detachable base plate comprising attachment means operable to allow attachment of the detachable base plate to the field stretcher and sheltering means operable to be secured over the field stretcher or field stretcher and detachable base.

All of the features contained herein may be combined with any of the above aspects and in any combination.

Figure 2:
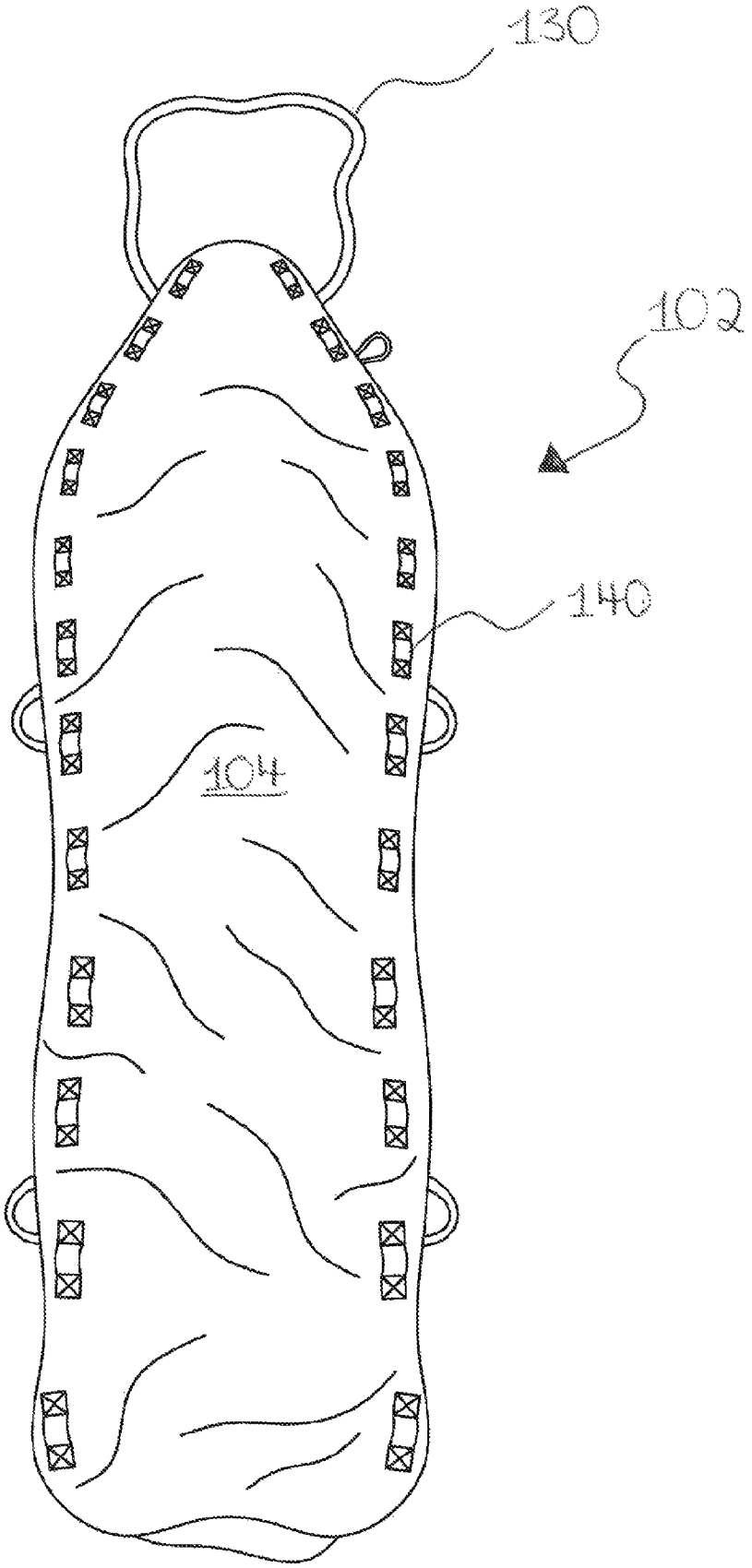
Figure 3:
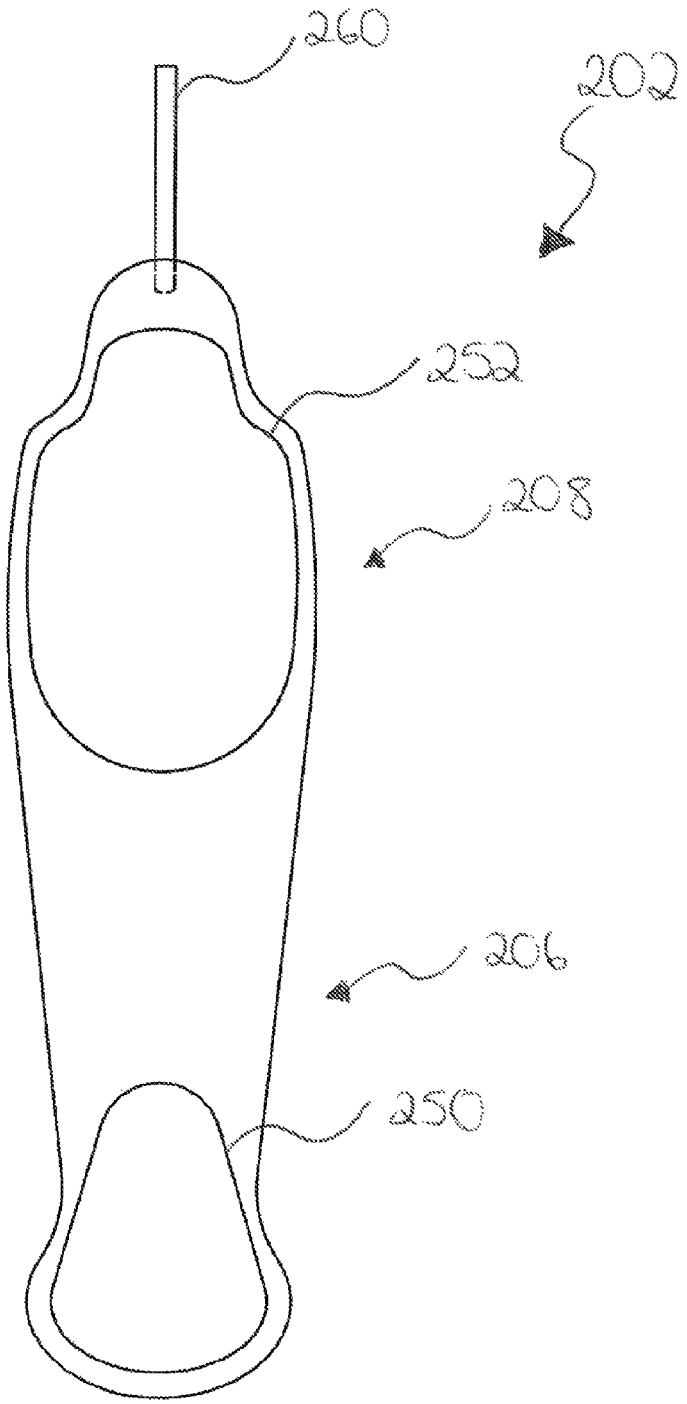
Figure 4:
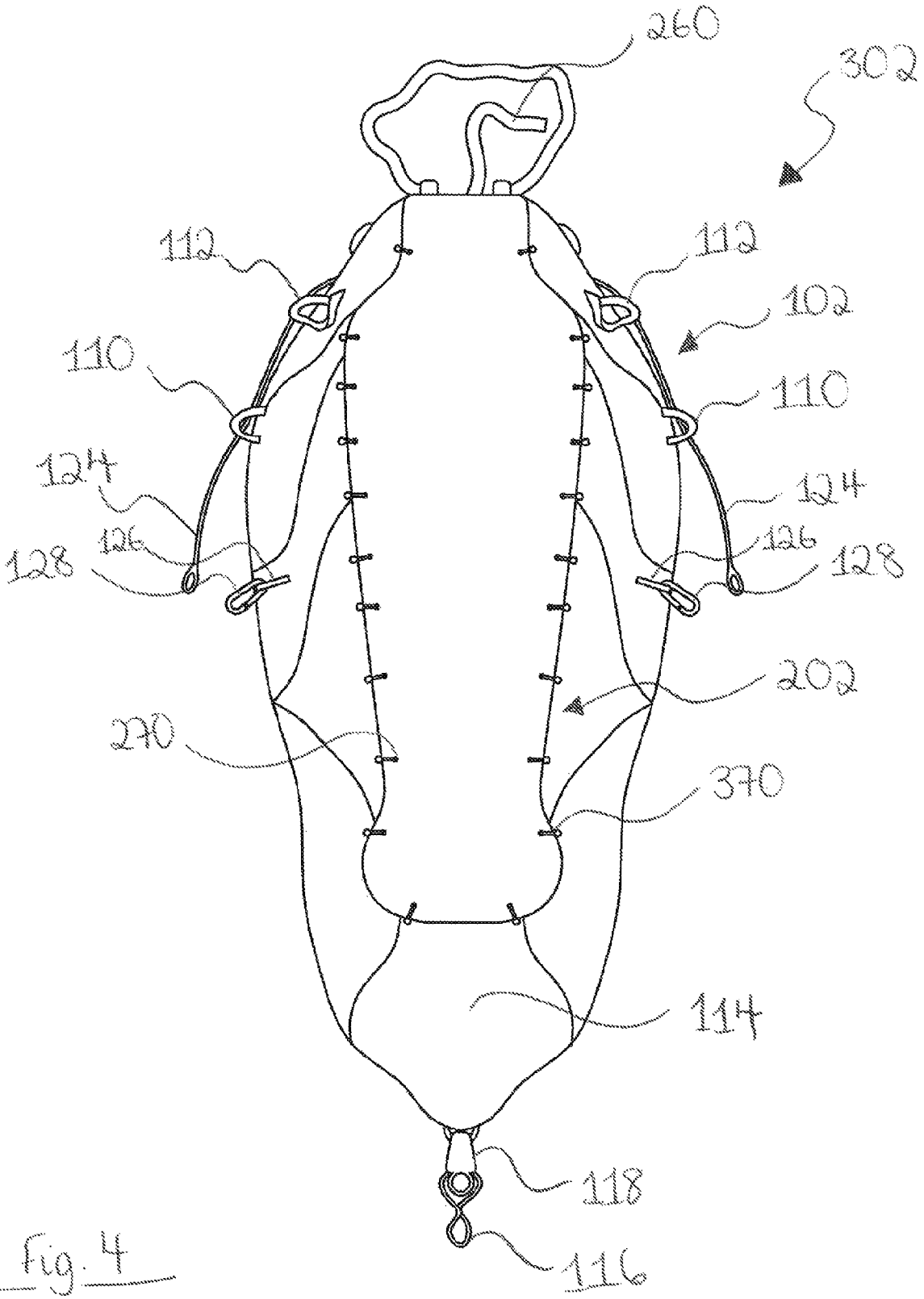
Figure 5:
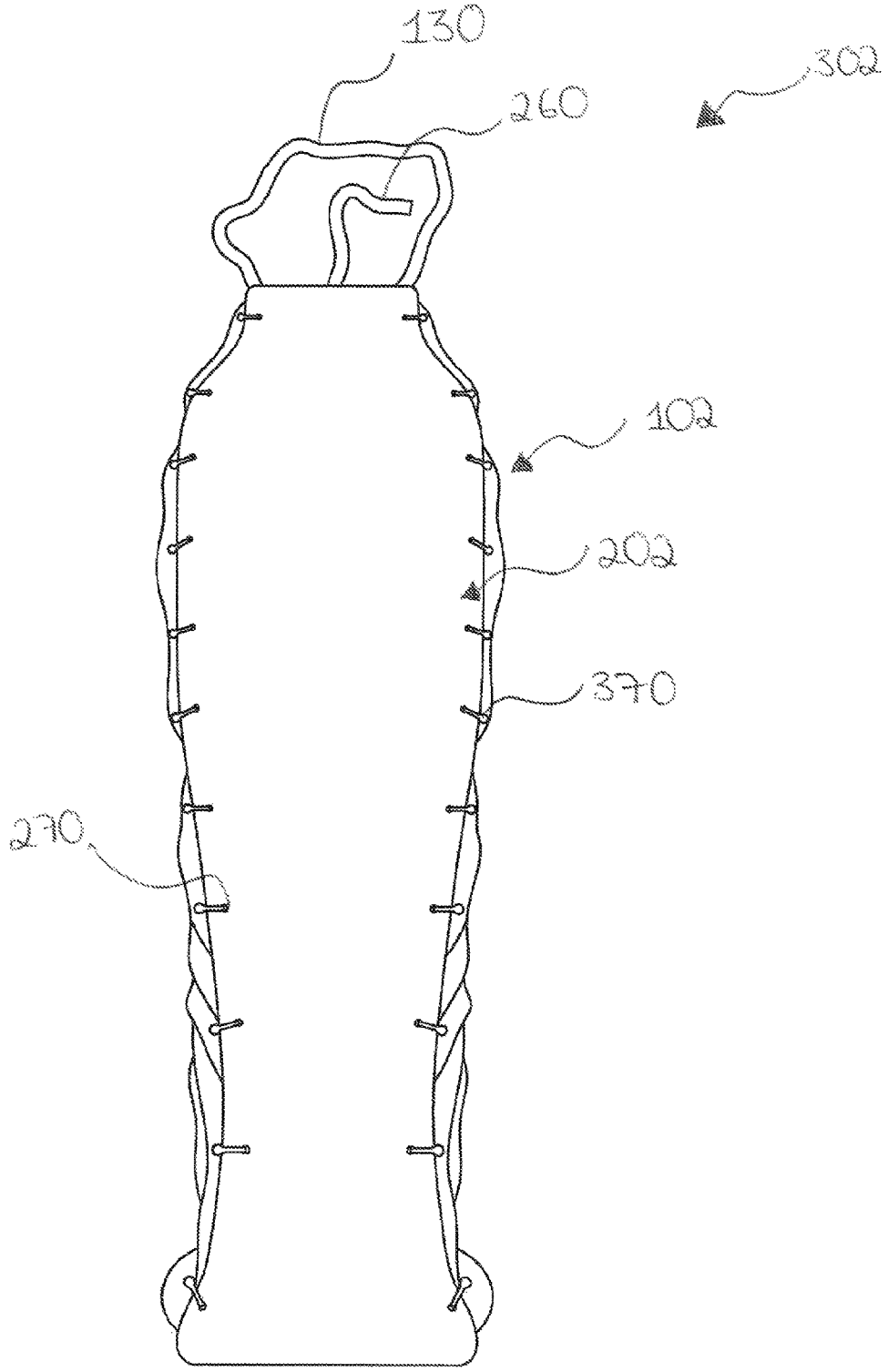
Figure 6:
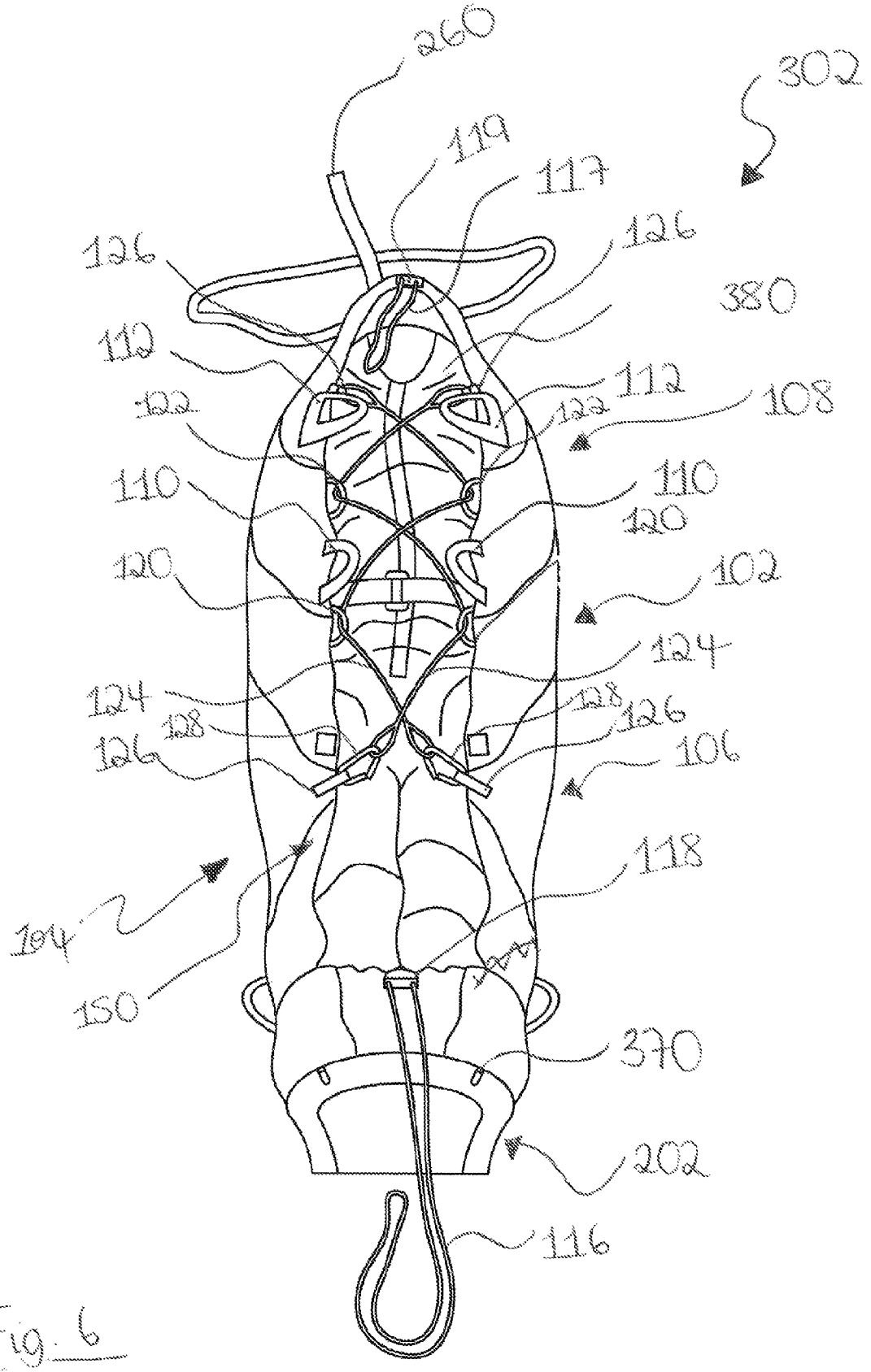
Figure 7:
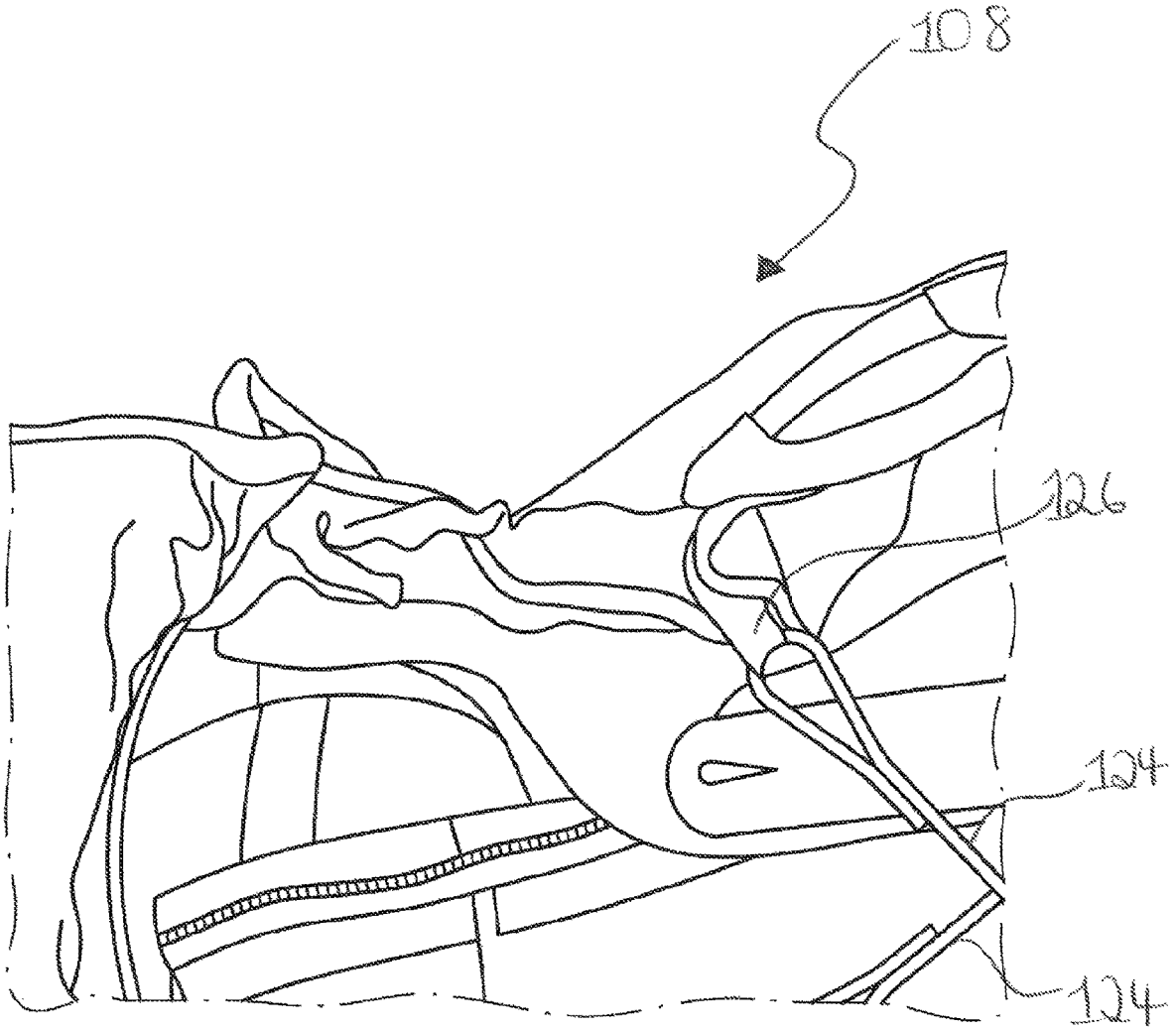

For a better understanding of the invention, and to show how embodiments of the same may be carried into effect, reference will now be made, by way of example, to the accompanying diagrammatic drawings in which:

FIG. 1 shows a plan view of a field stretcher according to the first aspect of the present invention FIG. 2 shows an under-plan view of the underside of a field stretcher according to the first aspect of the present invention, in use, showing the attachment means thereon FIG. 3 shows a plan view of a detachable base plate according to the second aspect of the present invention showing insulation material thereon FIG. 4 shows a under-plan view of the underside of the assembled field stretcher and detachable base plate according to the third aspect of the present invention showing the base plate attached to the field stretcher FIG. 5 shows a perspective view of the underside of the assembled field stretcher and detachable base plate according to the third aspect of the present invention in a patient carrying configuration, in use, showing the base plate attached to the field stretcher FIG. 6 shows a perspective view of the assembled field stretcher and detachable base plate according to the third aspect of the present invention, in use, having a patient retained therein FIG. 7 shows perspective view of the upper region of the field stretcher shown in FIG. 6.

Figure 8:
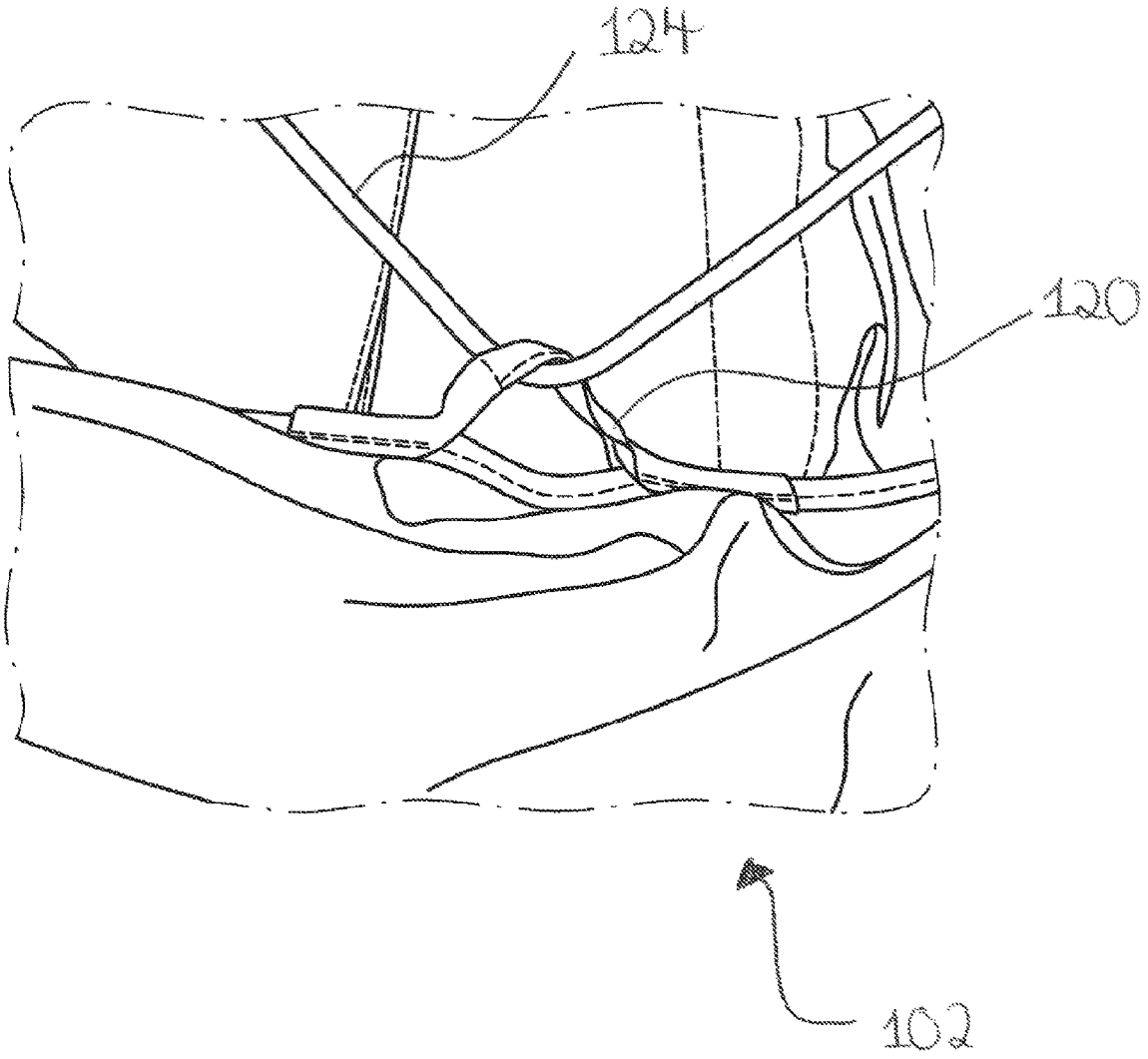

FIG. 8 shows a close up perspective view of the linking means shown in FIG. 6.

Referring to FIG. 1 there is provided a field stretcher 102 having a patient carrying portion 104. The patient carrying portion 104 is generally coffin shaped in plan, being an irregular hexagon, to mirror the general shape of a human body. In this manner, the carrying portion 104 is generally elongate and has a lower region 106, where a lower part of the patient's body is situated in use, and an upper region 108 where an upper part of the patient's body is situated, in use.

Pairs of handles 110 and 112 are situated at edges of the stretcher 102. A first pair of handles 110 is situated on either side of the patient carrying portion 104 towards the lower region 106 thereof and a second pair of handles 112 is situated on opposing sides of the patient carrying portion 104, at or towards the upper end of the patient carrying portion 104, corresponding generally to the position of a patient's shoulder and neck area of the injured person, in use.

The lower region 106 comprises an upstanding covering portion 114. As the patient carrying portion 104 is formed from a fabric material, the upstanding covering portion 114 is shown as being folded flat in FIG. 1.

Around the edge of the lower region 106 of the patient carrying portion 104 is a first drawstring 116 housed in a channel (not shown). The first drawstring 116 has a toggle 118 thereon situated half way along the upstanding covering portion 114. Around the edge of the upper region 108 of the patient carrying portion 104 is a second drawstring (not shown) housed in a channel (not shown). The second drawstring (not shown) has a toggle 119 thereon situated half way along the longitudinal end of the upper region 108 of the field stretcher 102.

Linking means, in the form of a pair of handles 120 and 122 are situated along the edges of the stretcher 102. A first linking means, in the form of a pair of handles 120 is situated on either side of the patient carrying portion 104 towards the lower region 106 thereof and a second linking means, in the form of a pair of handles 122 is situated on opposing sides of the patient carrying portion 104, at or towards the upper end of the patient carrying portion 104. Securing means 124, in the form of elasticated line are situated at and extend from upper attachment points 126 which are situated on opposing sides of the patient carrying portion 104, at or towards the upper end of the patient carrying portion 104, in the region of the shoulder and neck area of the injured person. The securing means are operable to be threaded through the apertures of the linking means 120 and 122. The securing means 124 are operable to be fixed to lower attachment points 126 on opposing side of the patient carrying portion 104, at or towards the lower end of the patient carrying portion 104 by fixing means in the form of a karabiner 128.

The patient carrying portion 104 comprises a handle 130 at the longitudinal end of the upper region 108 of the patient carrying portion 104.

Referring to FIG. 2, there is provided the underside of the field stretcher 102 comprising a patient carrying portion 104, in use. Attachment means 140 are situated around the perimeter of the underside of the field stretcher 102. The patient carrying portion 104 comprises a handle 130, at the longitudinal end of the upper region of the patient carrying portion 104.

Referring to FIG. 3, there is provided a detachable base plate 202. The detachable base plate 202 is generally coffin shaped in plan, being an irregular hexagon, to mirror the general shape of a human body. In this manner, the detachable base plate is generally elongate and has a lower region 206 and an upper region 208 corresponding to the lower region 106 and the upper region 108 of the patient carrying portion 104 of the field stretcher 102. A first section of insulation material 250, comprising a single layer, is situated on the upper surface of the detachable base plate 202 in the lower region 206 and a second section of insulation material 252, comprising a single layer, in the upper region 208 of the detachable base plate 202. A plurality of attachment means (apertures) 209 are situated around the perimeter of the detachable base plate 202.

The detachable base plate 202 comprises a handle 260, at the longitudinal end of the upper region 208 of the detachable base plate 202.

Referring to FIG. 4, there is provided the underside of the assembled field stretcher and base plate 302. The assembled field stretcher and base 302 comprises the field stretcher 102 attached to the detachable base plate 202. Linking members, in the form of a tag 370 allow attachment between the attachment means (not shown) of the field stretcher 102 and the attachment means (apertures) 270 of the base plate 202.

Pairs of handles 110 and 112 are situated at the edges of the stretcher 102. Securing means 124, shown not in use, are situated at and extend from upper attachment points (not shown). Fixing means, in the form of a karabiner 128 are situated at lower attachment points 126 operable to fix the securing means 124 to lower attachment points 126 on opposing sides of the patient carrying portion. Around the lower region of the patient carrying portion is a first drawstring 116 housed in a channel (not shown). The first drawstring 116 has a toggle 118 thereon situated halfway along the upstanding covering portion 114, shown as being folded flat in FIG. 4.

The assembled field stretcher and base plate 302 comprises a handle 260 at the longitudinal end of the upper region of the base plate 202, as shown in FIG. 3. The field stretcher comprises a handle 130, at the longitudinal end of the upper region of the patient carrying portion, as shown in FIG. 2.

Referring to FIG. 5, there is shown the underside of the assembled field stretcher and base plate 302, in use, having a patient (not shown) retained therein. The assembled field stretcher and base 302 comprises the field stretcher 102 attached to the base plate 202, in use. Linking members, in the form of a tag 370 allow attachment between the attachment means (not shown) of the field stretcher 102 and the attachment means in the form of an aperture 270 of the detachable base plate 202, as shown in FIG. 4. The assembled field stretcher and base plate 302 comprises a handle 260 at the longitudinal end of the upper region of the base plate 202. The field stretcher 102 comprises a handle 130 at the longitudinal end of the upper region of the patient carrying portion, as shown in FIG. 2.

Referring to FIG. 6, there is shown an assembled field stretcher and base plate 302, in use, having a patient 380 retained therein. The assembled field stretcher and base 302 comprises the field stretcher 102 attached to the base plate 202, in use. The sides of the stretcher have been pulled up over the sides of the patient 380 and the covering portion has been pulled up over the patient's feet. The first drawstring 116 has been drawn so that the lower end of the stretcher 102 forms a pocket (150) in which the patient 380 is retained. A second drawstring 117 has been drawn so that the upper end of the stretcher 102 encloses the patient's head. This is facilitated by holding the toggles 118 and 119 and pulling the drawstrings 116 and 117 therethrough. The toggles 118 and 119 serve to hold the drawstrings 116 and 117 in the drawn configuration.

Pairs of handles 110 and 112 are situated at the edges of the stretcher 102. A first pair 110 is situated on either side of the patient carrying portion 104 towards the lower region 106 thereof and a second pair of handles 112 is situated on opposing sides of the patient carrying portion 104, at or towards the upper end 108 of the patient carrying portion 104, corresponding to the region of the shoulder and neck area of the injured person, in use. Linking means, in the form of a pair of handles 120 and 122 are also situated at edges of the stretcher 102. A first linking means, in the form of a pair of handles 120 is situated on either side of the patient carrying portion 104 towards the lower region 106 thereof and a second linking means, in the form of a pair of handles 122 is situated on opposing sides of the patient carrying portion 104, at or towards the upper end 108 of the patient carrying portion 104. Securing means 124, in the form of elasticated line are situated at and extend from upper attachment points 126 which are situated on opposing sides of the patient carrying portion 104, at or towards the upper end of the patient carrying portion 104, in the region of the shoulder and neck area of the injured person. The securing means 124 are threaded through the apertures of the first and second linking means 120 and 122 and overlap across the body of the patient 380. The securing means 124 are fixed to lower attachment points 126 on opposing side of the patient carrying portion 104, at or towards the lower end 106 of the patient carrying portion 104 by fixing means in the form of a karabiner 128.

The base plate 202 is attached to the field stretcher 102 by linking members, in the form of a tag 370. The linking members 370 allow attachment between the attachments means (not shown) of the field stretcher 102 and the attachment means (not shown) of the base plate 202.

The assembled field stretcher and base plate 302 comprises a handle 260 at the longitudinal terminus of the upper region (not shown) of the base plate 202. The field stretcher 102 comprises a handle 130, at the longitudinal end of the upper region 108 of the patient carrying portion (not shown), as shown in FIG. 1.

Referring to FIG. 7, there is provided the upper region 108 of the assembled field stretcher and base plate 302 shown in FIG. 6. Upper attachment points 126 are situated on opposing sides of the patient carrying portion (not shown) in the region of the shoulder and neck area of the patient. Securing means, in the form of elasticated line 124 are situated at and extend from upper attachment points 126 and pass through the apertures of linking means (not shown) situated along the edges of the patient carrying portion (not shown) of the stretcher 102.

Referring the FIG. 8, there is provided a close up perspective view of linking means 120, in the form of a pair of handles (one handle shown) situated along the sides of the field stretcher 102. Securing means 124, in the form of elasticated line (one shown) are threaded through the apertures of the linking means 120.

A field stretcher made in accordance with the present invention allows a patient to be retained within a pocket of the stretcher 102 and thus when transported, for example by dragging handles 110 and 112, the patient is less likely to roll off the stretcher 102. Also, as discussed above, in the theatre of war, soldiers often sustain major injuries to their feet and legs and, in severe cases, the legs may be removed, such as by land mines, for example. In such a scenario, the elongate extent of the field stretcher of the present invention can be significantly reduced to accommodate a person in this condition securely. The stretcher has the further advantage that the handles are situated at the right positions with regard to the patient, because the length of the stretcher 102 is adjusted to suit the patient.

The stretcher has the further advantage that the securing means to retain the patient securely within the patient carrying portion are secured at or towards attachment points situated at or towards the upper end thereof, in the region of the head and shoulders of the patient. When in use, the stretcher prevents excessive movement of the head and neck of the injured person.

The attachment of the detachable base plate 202 to the field stretcher 102 enables the field stretcher to be utilised on different terrains. In addition, when attached, the base plate provides insulation from the ground for an injured person and also provides support to the spinal region of the patient.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A field stretcher, comprising:

a patient carrying portion including a peripheral edge, a detachable base plate having a coffin-shaped configuration generally corresponding to the shape and configuration of the patient carrying portion, wherein the patient carrying portion has a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring;

a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

2. A field stretcher according to claim 1, wherein the field stretcher comprises one or more handles, to thereby facilitate the stretcher being dragged.

3. A field stretcher according to claim 1, wherein the patient carrying portion comprises one or more handles along sides thereof, wherein the handles are arranged in pairs, preferably at opposing sides of the patient carrying portion.

4. A field stretcher according to claim 1, wherein the patient carrying portion comprises at least one tensioning line to secure and retain a patient with the pocket during transport.

5. A field stretcher according to claim 4, wherein the at least one tensioning line is situated at or toward upper attachment points, which may be situated at opposing sides of the patient carrying portion, at or towards the upper end thereof, such as in the region of the shoulder and neck area of the patient.

6. A field stretcher according to claim 4, wherein the at least one tensioning line is secured at and may extend from upper attachment points and in use, pass across the chest of an injured person and over to linking means on the opposite side of the patient carrying portion.

7. A field stretcher according to claim 4, wherein the linking means comprise an aperture therethrough, through which the at least one tensioning line may be threaded.

8. A field stretcher according to claim 4, wherein the at least one tensioning line terminates in a looped region operable to engage with fixing means.

9. A field stretcher according to claim 8, wherein the fixing means fixes a securing means to lower attachment points on opposing sides, at or towards the lower end thereof of the patient carrying portion.

10. A field stretcher according to claim 1, wherein the patient carrying portion comprises one or more linking means along the sides thereof, wherein the linking means are arranged in pairs.

11. A field stretcher according to claim 1, wherein the attachment means comprises a plurality of loops.

12. A field stretcher according to claim 1, wherein the detachable base plate has a lower region and an upper region, wherein the lower region generally corresponds to a position of a lower portion of the patient's body, in use, and the upper region generally corresponds to a position of an upper portion of a patient's body, in use.

13. A field stretcher according to claim 1, wherein the upper surface of the detachable base plate comprises a layer of insulating material.

14. A field stretcher according to claim 1, comprising dragging means at or toward the end of the upper region thereof, positioned in proximity to the edge of the detachable base plate.

15. A field stretcher according to claim 1, wherein the attachment means are arranged so as to extend around the perimeter of the detachable base plate.

16. A field stretcher according to claim 1, wherein the attachment means comprises apertures in the material of the detachable base plate.

17. A field stretcher according to claim 1, wherein the attachment means are located so as to correspond with the position of the attachments on the underside of the field stretcher.

18. A field stretcher according to claim 1, wherein the attachment means engage with a linking member that forms an attachment between the attachment means of the base plate and the corresponding attachment means on the underside of the field stretcher.

19. A field stretcher according to claim 18, wherein the attachment means comprises a linking member as an integral part.

20. A field stretcher assembly, comprising: a field stretcher comprising a patient carrying portion including a peripheral edge, a detachable base plate having a coffin-shaped configuration generally corresponding to the shape and configuration of the patient carrying portion, a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring;

a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

21. A field stretcher kit, comprising: a field stretcher comprising a patient carrying portion including a peripheral edge, a detachable base plate having a coffin-shaped configuration generally corresponding to the shape and configuration of the patient carrying portion, wherein the patient carrying portion includes a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring;

a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

22. A field stretcher assembly, comprising: a field stretcher comprising a patient carrying portion including a peripheral edge, a detachable base plate having a coffin-shaped configuration generally corresponding to the shape and configuration of the patient carrying portion, wherein the patient carrying portion includes a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring;

a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

23. A field stretcher kit comprising: a field stretcher comprising a patient carrying portion including a peripheral edge, a detachable base plate having a coffin-shaped configuration generally corresponding to the shape and configuration of the patient carrying portion, wherein the patient carrying portion includes a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring;

a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

24. A sheltering means operable to be secured over a field stretcher, the field stretcher comprising a patient carrying portion including a peripheral edge, a detachable base plate having a coffin-shaped configuration generally corresponding to the shape and configuration of the patient carrying portion, wherein the patient carrying portion includes a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring;

a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

25. A sheltering means operable to be secured over a field stretcher assembly, the field stretcher assembly comprising: a field stretcher comprising a patient carrying portion including a peripheral edge, a detachable base plate having a coffin-shaped configuration generally corresponding to the shape and configuration of the patient carrying portion, wherein the patient carrying portion includes a lower region generally corresponding to a position of a lower portion of a patient's body, in use and tensioned by a drawstring; and an upper region generally corresponding to a position of an upper portion of a patient's body, in use and tensioned by a drawstring; and between the upper and lower portions at least one tensioning line, wherein the lower region drawstring, upper region drawstring, and at least one tensioning line form a pocket that secures and substantially envelops the patient when in use;

wherein the patient carrying portion has a length, and the length of the patient carrying portion can be shortened by tensioning the upper region drawstring; and a plurality of attachment means to attach the patient carrying portion to the detachable base plate disposed around a perimeter and substantially adjacent the peripheral edge of the patient carrying portion on an underside thereof; and, wherein each of the plurality of attachment means includes an aperture positioned transverse to the peripheral edge.

* * * * *